United States Patent [19]

Breeze

[11] 4,394,653

[45] Jul. 19, 1983

[54] BI-DIRECTIONAL DRIVE MULTIPLEXED DISPLAY SYSTEM

[75] Inventor: Eric G. Breeze, Los Altos, Calif.

[73] Assignee: General Instrument Corporation, New York, N.Y.

[21] Appl. No.: 210,133

[22] Filed: Nov. 24, 1980

[51] Int. Cl.[3] ..... G09G 3/14

[52] U.S. Cl. ..... 340/802; 340/762; 340/713; 340/825.82

[58] Field of Search ..... 340/147 R, 166 R, 166 EL, 340/802, 782, 762, 713, 825.79, 825.81, 825.82

[56] References Cited

U.S. PATENT DOCUMENTS

| | | | |
|---|---|---|---|
| 3,717,867 | 2/1973 | Rosenzweig | 340/336 |
| 3,755,806 | 8/1973 | Bunting | 340/324 |
| 3,803,587 | 4/1974 | Mead | 340/336 |
| 3,918,041 | 11/1975 | Mao | 340/336 |
| 3,925,775 | 12/1975 | Gay | 340/324 |
| 3,943,500 | 3/1976 | Buchanan | 340/253 R |
| 3,990,070 | 11/1976 | Spence | 340/337 |
| 3,993,979 | 11/1976 | Mehlich | 340/166 R |
| 4,106,369 | 4/1977 | Pedersen | 340/147 R |
| 4,188,626 | 2/1980 | Frantz | 340/711 |
| 4,194,199 | 3/1980 | Shepherd | 340/754 |
| 4,206,458 | 6/1980 | Sado | 340/756 |

*Primary Examiner*—Marshall M. Curtis
*Attorney, Agent, or Firm*—Roland Plottel

[57] ABSTRACT

This system is for use with multicharacter displays. Each character being composed of a plurality of segments which are of a unidirectional type, e.g. an LED. Selected segments of each character are sequentially illuminated to display alphanumeric or other symbols. In this system the number of interconnections between the display and a drive circuit is greatly reduced. For example an 8-character display where each character has 7 segments would require only 8 leads.

15 Claims, 3 Drawing Figures

BI-DIRECTIONAL DRIVE MULTIPLEXED DISPLAY SYSTEM

BACKGROUND OF THE INVENTION

1. Field of the Invention

The invention relates generally to display systems, and more particularly to a display having a plurality of characters, each of which is composed of plurality of segments which are electrically unidirectional, e.g. Light Emitting Diode.

2. Description of the Prior Art

Prior Art displays are well known. A typical example is the numerical display in a hand-held calculator. There are typically 8 characters or digits. Each character is made of 7 segments which are arranged in the shape of an "8". If all the segments are illuminated, then the number "8" is displayed, and by selectively illuminating different combinations, the digits from 0–9 are displayed. Segments may be either unidirectional, such as LED's, or bi-directional, such as liquid crystals. The present invention relates to the unidirectional type segment.

In the prior art, the segments of each character are turned on, or illuminated, in a multiplexed fashion. For example, the human eye has a persistence of about 50 milliseconds. The segments representing the number to be displayed on the first character of the display are turned on for 2 or 3 milliseconds. Then the segments corresponding to the number to be displayed in the second character are turned on or illuminated in the next 2 or 3 milliseconds; and so on for each character in the display. After the last character in the display, the drive then repeats by illuminating the first character. In this arrangement the segments in each of the characters are turned on for a few milliseconds. The human eye interprets this as a continuously ON light, so long as the segments in each display are refreshed or reilluminated more often than every 50 milliseconds, which is the presistence of the human eye.

In the prior art display systems there are a large number of leads connecting the multiplex drive circuit and the displays. For example, in a display having 8 characters, each character having 7 segments; there are 7 leads connecting corresponding segments of the characters in parallel; and 8 strobe leads, one to each character in the display. Signals as to which segments are to be illuminated in a character go out on the 7 segment leads, and a signal as to which character in the display is to display that number is carried on the 8 strobe leads. Coincidence on the two signals at a particular character causes those segments in that character to illuminate. The number of leads can be generalized as equal to the number of segments in each character; plus the number of characters in the display. In the example above, this number is 15.

It is a desirable and classical goal to reduce the number of leads between the drive circuit and the display. There are several reasons to reduce the number of leads to a minimum. First, as the drive circuits are made on an integrated circuit chip and these chips get smaller and more functions are put on a single chip, the amount of space required for pads needed to connect to the leads should also be reduced. Fewer leads and pads means fewer interconnections between pads on the integrated circuit chip and the I.C. housing, and fewer pins on the I.C. housing. Next the number of interconnected lead patterns on the drive circuit are also reduced. This reduces labor and material cost, but also improves quality, as there are fewer errors and a higher yield with fewer connections. Finally, fewer interconnections means less radio frequency interference.

The present invention is an interconnection of leads between unidirectional segmented display and a multiplexed drive circuit in which the number of leads are reduced from what was heretofore required. For example in the 7-segment 8-character display, only 8 leads are required, a reduction of almost 50%. A 16-segment (alphanumerical symbol) 16-character display requires only 17 leads, while the prior art requires 32.

The present invention achieves the goal of a reduced number of interconnections between display and drive circuit while using the same multiplexed rates and duty cycles as conventional multiplexed display systems. It achieves the goal of reduced number of leads, reduced number of pin-out in the display drive circuit (typically in a DIP package), and a corresponding reduced number of pads on the integrated circuit chip. The likelihood or chance of radio frequency interference is reduced due to less interconnections. There is a potential of lower cost of LED display modules and the associated drive circuit, as well as improved quality and yield with a higher number of good units manufactured.

An object of the invention is to provide an improved multiplexed display system having a unilateral segmented characters in which the number of leads between the drive circuit and the display is reduced.

Another object of the invention is to provide a novel display which is easier to assemble and repair, and which has a higher yield due to a reduced number of interconnections between the drive circuit and the display.

SUMMARY OF THE INVENTION

According to the invention there is provided an apparatus with a display having a plurality of characters each of which has N segments, each of the segments being unidirectional with two terminals of different polarities. N+1 busses are interconnected with the characters, each character having N of the N+1 busses connected to like-polarity polarity terminals of the N segments of that character. The N+1th bus for that character is connected to the other polarity terminals of the segments of that character. The N+1th bus is a different buss for each character. Another aspect of the invention is a system having a display of a plurality of uni-directional segmented characters, a drive circuit for the display, and a plurality of busses interconnecting the drive circuit and the display. The number of busses is equal to the number of segments in a character plus 1. All of the segments are unidirectional and each has two different polarity terminals. All the terminals of one polarity of the segments of one character are connected to one bus or the strobe bus for that character; and each of the other terminals of the segments of that character are connected to the other busses, which are the segment busses for that character. The strobe bus is a different bus for each character; and the bus that serves as the strobe bus for one character serves as an other, or segment, bus for the other characters. The segment busses are connected to one segment in each character and those segments in one embodiment are connected in parallel. The drive circuit drives the characters in multiplexed fashion, one at a time, and provides a strobe signal on the strobe bus to a given character and segmented signals on the other busses. The segments of all the other characters are biased-off by the absense of a strobe signal on their strobe busses. This is because a segment signal and a strobe signal are, for example, of opposite polarity. The drive and strobe signals are sequentially applied on the busses to illuminate the characters.

DETAILED DESCRIPTION OF THE INVENTION

Figure 1:
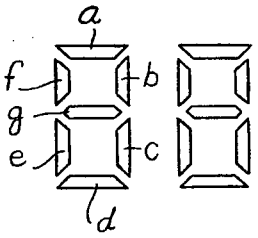
FIG. 1 is a plain view of 7-segmented characters of a display.

In FIG. 1 there are shown 2 characters, each of 7 segments. The segments are unidirectional such as light emitting diodes or vacuum florescent display. Each character has 7 segments designated a, b, c, d, e, f and g, arranged in the form of a figure 8. To display a figure or a letter appropriate segments are illuminated. This is conventional and not described here. In the conventional display all the corresponding segments of each character are connected together in parallel to a common segment bus. In the prior art each character has the other terminal of each segment connected to a separate strobe lead, thus for example, in the prior art, an 8-character display would have 7 segment leads and 8 strobe leads. In the prior art, when a digit is to be displayed on a character, the segment leads that correspond to the segments of that digit are all activated, however, only the strobe signal is applied to one character and only that character can be illuminated. This is conventional and is thus not described in further detail. The duty cycle or time the segments are "on" as noted above is relatively short, e.g. a few milliseconds compared with the retentivity of the human eye, of approximately 50 milliseconds so that all the characters in the display can be illuminated within a 50 millisecond period.

Figure 2:
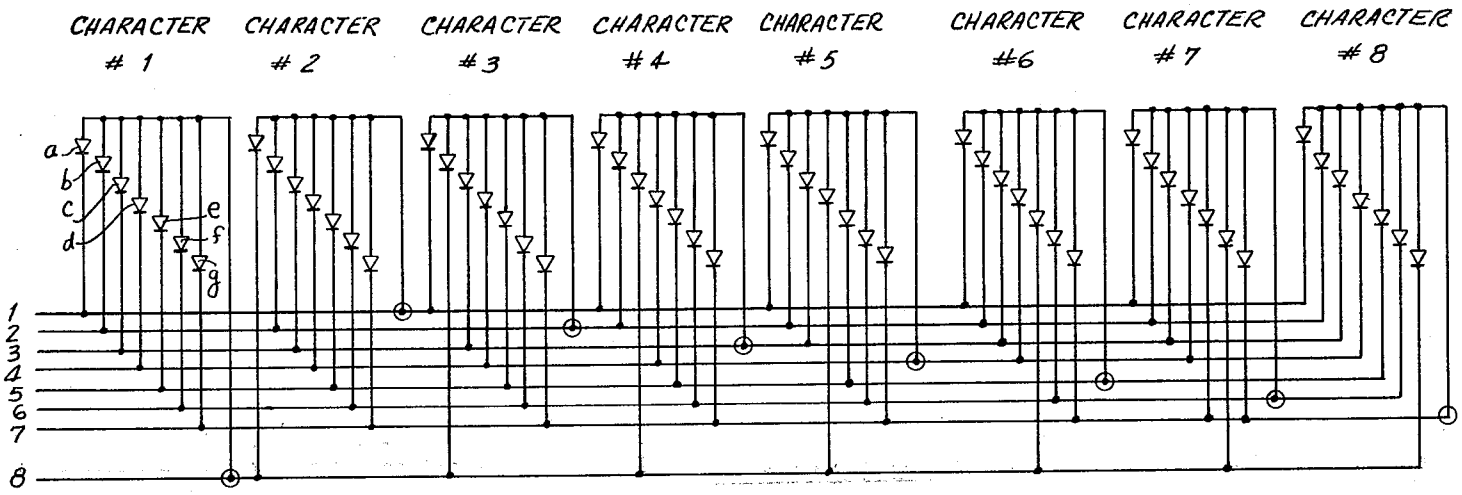
FIG. 2 is a schematic diagram of a display and bus system according to one aspect of the invention.

Referring now to FIG. 2 which is a schematic diagram of an 8-character 7-segment display in accordance with the invention. The segments of each character are shown as diodes, as they are unidirectional, and are designated a,b,c,d,e,f, and g, corresponding to the segments of FIG. 1. One common terminal (the cathode) of all the segments or diodes of a character are connected together to a strobe lead S. In the invention the number of leads or busses is equal to the number of segments +1, and in the example there are 8 leads bearing the legend 1–8. The other terminal (the anodes) of each diode a–g of each character are connected to a different one of seven of the eight busses 1–8. It will be noted that unlike the prior art, where all of the corresponding segments of the characters are connected in parallel to one lead, in the present invention, corresponding segments of only seven of the eight characters are connected in parallel to the same lead. For example, the diodes a in the 1st, 3rd, 4th, 5th, 6th, 7th, and 8th characters are connected to the lead; while diode a in the 2nd character is connected not to lead 1, but to lead 8. Similarly the diodes b are connected to lead 3 for all the characters except the 3rd. This can be described in another way. The eight connections from a character are interconnected with the eight leads 1–8 so that the strobe connection S is to a different one of the leads 1–8 for each different character. In the embodiment shown in FIG. 2 when strobe lead S of a character is connected to a lead in parallel with like segments of other characters, that segment of that character is connected to lead 8.

The operation of the circuit of FIG. 2 is as follows. The diodes a–g are unidirectional, and require for example approximately +2 volts to illuminate. To turn on the segments in the first character, a pulse, for example 2.5 volts, is applied on leads 1–7 for those segments a–g which are to be turned on, and a suitable low impedance, low voltage, for example 0 volts, are applied on lead 8. The current then flows from leads 1–7 to the anodes of the first character, and then through those segments (diodes a–g) to lead 8 which have ground potential, thereby illuminating the diodes through which the current is flowing. Those diodes a–g which are not to be turned on see a high impedance open circuit on their leads 1–7.

The second through eighth characters segments are not turned on because each segment in each of those 2nd–8th characters is back-biased and/or sees a high impedance and thus has no current conducting path. For example, in the 2nd characters diode a is back-biased and there is no conduction path therethrough. Likewise for the 3rd character, diode b is back-biased; and so on.

In the multiplexing scheme the 2nd character is next to be turned on. Here the low voltage≈ 0 V signal is applied on lead 1 which is connected to the S terminal and to the cathodes of the diodes a–g of the 2nd character. Segment information for segment a is applied on lead 8 and on leads 2–7 for segments b–g. For those diodes which see a high voltage≈ +2.5 V, current flows from leads 2–8 to lead 1 through those segments or diodes and their corresponding leads 1 and 2–8.

Similarly for the 3rd character, the low impedance strobe signal is applied on lead 2, diodes a and c–g are connected to leads 1 and 3–7 respectively, and segment b is connected to lead 8, (which carries the segment information for this 3rd character). The strobe or low impedance signal is applied on leads 3,4,5,6 and 7 for the 4th, 5th, 6th, 7th and 8th characters respectively, and diodes c,d,e,f, and g for the 4th, 5th, 6th, 7th and 8th characters respectively being connected to lead 8, which carries the segment information for the corresponding diodes.

The invention is not limited to displays having 7-segments and 8-characters. The relationship between (a) the number of segments in a character, (b) the number of characters in the display, and (c) the number of leads to the display may be generalized and expressed mathematically as follows:

M=the number of characters in a display,

N=the number of segments in a character, (1) When M less than or equal to N+1, the number of leads=N+1

Various designs may be used for the drive circuit. It is within the skill of those in the art to design a driver circuit, once its requirements have been defined, as is done above. There is described below and in FIG. 3 an embodiment of a of a drive circuit as constructed by the inventor.

Figure 3:
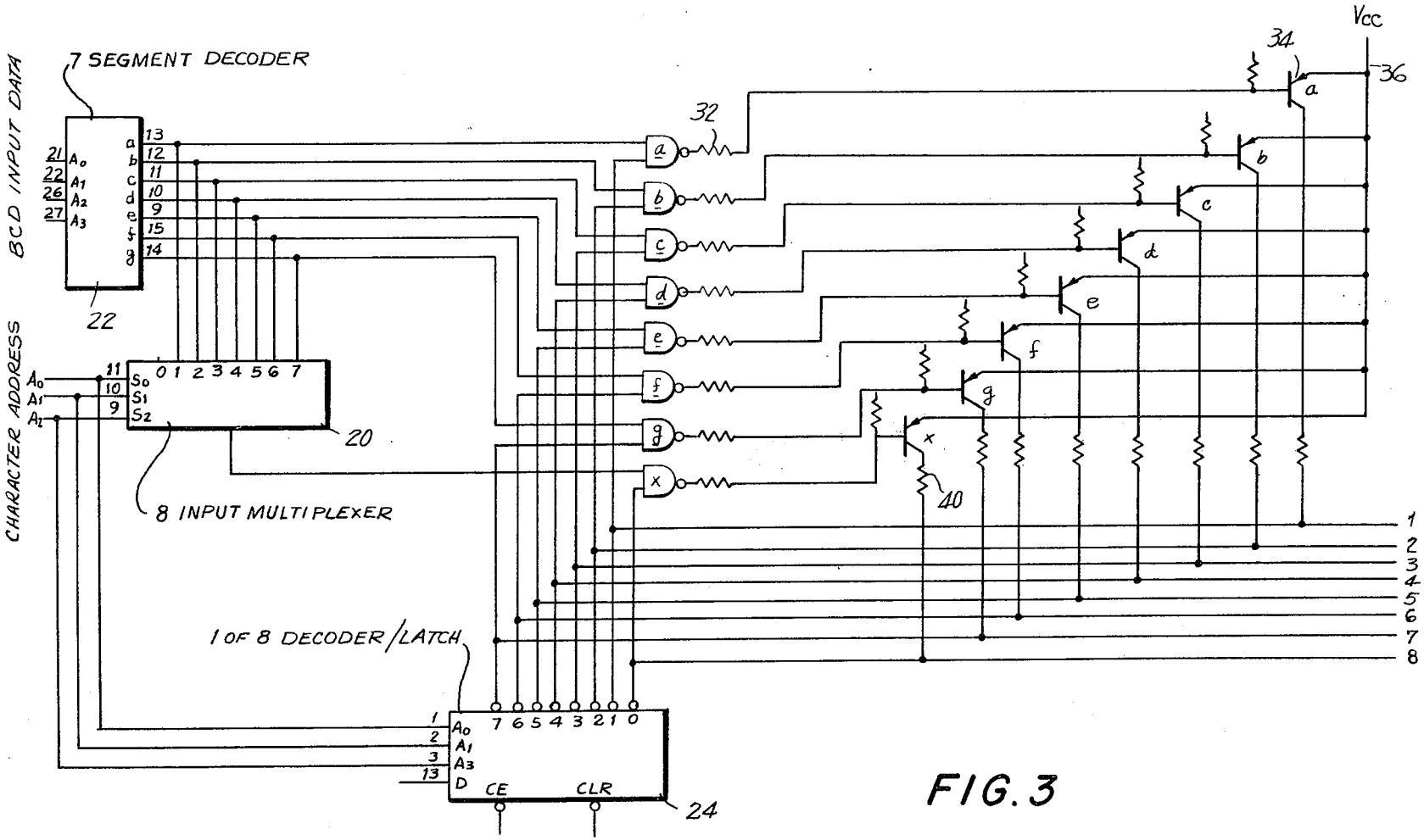
FIG. 3 is a schematic diagram of a drive circuit according to the invention for driving the display of FIG. 2.

Referring now to FIG. 3 there is shown a schematic and block diagram of a typical drive circuit. All the components used in the drive circuit are conventional, therefore only their terminal characteristics and overall operation are described.

In the lower right hand corner of FIG. 3 are the leads 1–8, which connect with the leads on the display of FIG. 2. The output of the drive circuit is an appropriate low impedance signal 0 V, on that one of the leads which is the strobe lead for the character being multiplexed, (lead 8 for the 1st character, lead 1 for the 2nd character, etc.); and a appropriate high voltage e.g. +2.5 V voltage on those leads which are connected to those segments of that character which are to be turned "on" and; a high impedance on those leads which are connected to those segments which are not to be illuminated. The drive circuit of FIG. 3 achieves this.

In the example here, the information to the drive circuit is a character address signal of three parallel bits; and a binary coded decimal, four parallel bit segment data signal. The former is applied on three parallel input leads to a 8-input multiplexer 20, and the latter signal is applied to a 7 segment decoder 22. The character address signal is also applied to a data/latch circuit 24 which is connected to a system clock, not shown, through lead 26.

Seven leads from the decoder 22 are connected to the multiplexer 20, and to one terminal of gates 30*a–g*. An 8th lead from the multiplexer 20 is connected to input of a gate 30*x*. The latch 24 has 8 output leads which are connected respectively to the 2nd input of the gates 30*a–g* and 30*x*. The outputs of the latch 24 are also directly connected to the leads 1–8 to provide the low impedance display strobe drive. The outputs of the gates 30 are connected through resistors 32 to the bases of transistors 34*a–g* and 34*x*. The emitters of each of these transistors is connected to a source of potential 36 and their collectors are connected through current limiting resistors 38 to the output leads 1–8. Thus in operation, whichever of the leads 1–8 is to have a segment signal would have the transistors 34 to which it is attached turned on, thereby providing the appropriate voltage. The strobe signal is supplied by the decoder/-driver/latch 24 and when "on" provides a low impedance to ground when a strobe signal is present. When a line is used as a strobe the segment drive transistor is turned 37 off" therebye disabling any segment data would be a proper impedance and voltage. The multiplexer and decoder provide suitable signals for the gates 30, and biased resistors 38 interconnect the resistors 32 to a power supply, (not shown), and current limit resistors 40 join the emitters to leads 1–8. As noted above, other drive circuits may be designed and constructed in accordance with the invention so long as they provide the sequence of drive signals as are needed and described above. The embodiment of FIG. 3 was made with the following components and is interconnected with a display whose diodes have a reverse polarity to that shown in FIG. 2:

multiplexer 20, type 74LS151
decoder 22, type 7448
latch 24, type NL590
resistor 32: 47 K
resistor 38: 2.2 K
resistor 40: 47 ohms
VCC, 5 volts It may be noted that the drive circuit may be built into integrated circuit chip of a calculator or whatever system need have its output displayed. Thus the decoder, multiplexer, latch, gates, transistors, and resistors may all be on the same chip with the other elements of the calculator or systems chip. Great advantage would be obtained in such manufacture because the calculator or system functions and the drive circuit functions would be combined in a single chip and the output of which would need, in the case of an 8-character display, merely 8 pads on the IC chip which in turn would go via the chip housing leads to the display leads 1–8. The size of the chip would still be quite small, because with the present invention the number of pads is about half of what was needed in the prior art, and space previously used by the pads may be used for the drive circuitry. There is thus a reduced number of pads which is of importance, and a potential reduced cost-complexity of manufacture as well as increased yield of manufacture, and additional savings in manufacture and particularly assembly.

I claim:

1. An apparatus comprising: a display having a plurality of characters, each of said characters having N segments, each of said segments being electrically unidirectional and having two terminals of different polarities said apparatus further consisting of; N+1 directly interconnected with said characters; each character having N of said N+1 busses connected to like polarity terminals of the N segments of that character, and the N+1th bus for that character being connected to all of the other polarity terminals of the segments of that character; and said N+1th bus being a different bus for each character.

2. An apparatus according to claim 1 where said plurality of characters is less than or equal to N+1.

3. An apparatus according to claim 1, or 2, where the character is a 7-segment digit.

4. An apparatus according to claim 1, or 2, where in said display segments are light emitting diodes, or fluorescent lamps.

5. An apparatus according to claim 1 wherein all of said N+1th busses of said plurality of characters are all connected to said other polarity terminals, and said N busses of said plurality of characters are all connected to said like polarity terminal.

6. An apparatus according to claim 1 wherein said characters have like segments, and the busses are connected to corresponding like segments in each character except for that character where the bus is the N+1th bus for that character.

7. A multiplexed display system comprising a display having a plurality of unidirectional segmented characters; a multiplexed drive circuit for said display for sequentially turning on the segments of the characters one character at a time; a plurality of buses directly interconnecting said drive circuit and display; the number of said directly interconnected buses being equal to the number of segments in a character plus 1; all of said segments being electrically unidirectional and each having two different polarity terminals; for each character, like polarity termianls of the segments are directly connected to one of said buses, and the other terminals of all of the segments of that character are each directly connected to another of the buses; said one bus being permitted among the buses for each different character and being a different bus for each different character; said drive circuit providing a strobe signal on a sequence of said one of said strobe buses and simultaneously segment signals on said other buses for illuminating segments of said character whose one bus receives said strobe signal, the segments of the other characters being thereby biased off.

8. A system according to claim 7, wherein each of said other busses being connected to only each segment in one character.

9. A system according to claim 7, wherein said other busses are connected to a plurality of corresponding segments in the characters.

10. A system according to claim 7, where the characters have N segments each and N corresponding segments of different characters are connected in parallel.

11. A system according to claim 16 wherein during one sequence of turning on one character, the multiplex drive circuit presents said strobe signal being a first signal on the one bus of the character to be illuminated, said segment signals being a second signal on those buses which are to turn on segments of said character, and a third signal on those buses which are not to turn on the other segments of said character.

12. A system according to claim 11, wherein said first signal is a voltage from a low impedance source, said second signal is different voltage from a a low impedance source, said two voltage forward biasing and providing current flow to said unidirectional segments; said third signal being a voltage from a very high impedance source such that there is no operable current flow through said segments.

13. A system according to claim 11, or 12, wherein said system includes a means for receiving data representative of the symbols to be displayed and the address of each symbol; said drive circuit includes a decoder latch (24) receiving said address data, and providing said first signal on said strobe bus; and a decoder (22) and a multiplexer (20) for receiving said segment and said address data respectively, for providing (30 and 34) said second and third signals to said busses.

14. A system according to claim 13, wherein said segment data input is in binary coded decimal, and said decoder decodes it to base N.

15. A multiplexed display system comprising a display having a plurality of unidirectional unidirectional segmented characters; a multiplexed drive circuit for said display for sequentially turning on the segments of the characters one character at a time; a plurality of buses interconnecting said drive circuit and display; the number of buses being equal to the number of segments in a character plus 1; all of said segments being unidirectional and each having two different polarity terminals, like polarity terminals of the segments of one character being connected to a strobe bus which is one of said buses, and each of the other terminals of the segments of that character being connected to segment buses which are the other buses; said strobe buses being a bus for each different character, said drive circuit sequentially providing a drive signal on one of said strobe buses and segment signals on said segment buses for illuminating said character whose strobe bus recieves said strobe signal, the other segments of the other characters being biased off; and wherein during one sequence of turning on one character, the multiplexed drive circuit presents a first signal on the strobe bus, a second signal on those buses which are to turn on segments of said character, and a third signal on those buses which are not to turn on the other segments of said character; said first signal is a voltage from a low impedance source; said second signal is a different voltage from a low impedance source, said two voltages forward biasing and providing current flow to said unidirectional segments; said third signal being from a very high impedance source such that there is no operable current flow through said segments.

* * * * *